United States Patent [19]

Ruffino

[11] Patent Number: 4,628,611

[45] Date of Patent: Dec. 16, 1986

[54] REAR GUN SIGHT

[76] Inventor: Mario F. Ruffino, 300 Beauregard Heights, Hampton, Va. 23669

[21] Appl. No.: 647,811

[22] Filed: Sep. 6, 1984

[51] Int. Cl.[4] ..... F41G 1/16

[52] U.S. Cl. ..... 33/254; 33/257; 42/1 S

[58] Field of Search ..... 33/252, 254, 256, 257, 33/233, 263; 42/1 S

[56] References Cited

U.S. PATENT DOCUMENTS

| | | | |
|---|---|---|---|
| D. 191,112 | 8/1961 | Elliason . | |
| D. 199,065 | 9/1964 | Korzeniewski . | |
| D. 252,764 | 8/1979 | Korzeniewski . | |
| D. 254,680 | 4/1980 | Behlert . | |
| 658,708 | 9/1900 | Fischer . | |
| 1,220,637 | 3/1917 | Johnson | 33/255 |
| 1,455,071 | 5/1922 | Browning . | |
| 2,044,855 | 6/1932 | Lundgren . | |
| 2,108,150 | 2/1938 | Swebilius . | |
| 2,187,096 | 6/1940 | Pomeroy . | |
| 2,484,368 | 10/1949 | Young . | |
| 2,610,406 | 9/1952 | Chambers . | |
| 3,495,339 | 2/1970 | Elliason . | |
| 3,882,623 | 5/1975 | Khaidurov et al. . | |
| 3,942,256 | 3/1976 | Khaidurov et al. . | |
| 3,984,917 | 10/1976 | Korzeniewski . | |
| 4,200,989 | 5/1980 | Brouthers . | |

FOREIGN PATENT DOCUMENTS 12603 of 1899 United Kingdom .

*Primary Examiner*—Harry N. Haroian

*Attorney, Agent, or Firm*—Finnegan, Henderson, Farabow, Garrett & Dunner

[57] ABSTRACT

A rear sight for a gun frame or slide. The rear sight includes an elongated sight body having at least one elongated front leg with a forward sight body recoil shoulder, a sighting blade slidably attached to the rear of the sight body to permit windage adjustment, and means for pivotably attaching the sight body to the gun frame or slide to permit elevation adjustment. The sight body fits within an elongated slot formed in the gun frame or slide so that the sight body recoil shoulder engages a frame recoil shoulder to bear the impact of the gun's recoil. The rear sight of the present invention includes a simplified elevation adjustment system and windage adjustment system.

17 Claims, 12 Drawing Figures

REAR GUN SIGHT

BACKGROUND OF THE INVENTION

1. Field of the Invention

The present invention relates generally to a rear gun sight which is fixed to the rear portion of a gun frame. More specifically, the specification describes a rear gun sight which fits within a recessed channel in the slide of a firearm so that the gun sight and slide form cooperating recoil shoulders.

2. Description of the Prior Art

A wide variety of rear gun sight designs have been developed in the past. The vast majority of these sights have an extremely complicated structure to accommodate the desired adjustments in the sight's elevation and windage. Moreover, many of the prior gun sights are attached to the gun's slide by transverse dovetail joints so that the major portion of the rear sight is fixed above the frame or slide of the firearm. Other sights are fixed to the top of the gun with screws or similar fixtures. When such rear sights are attached to a gun having a slide, such as that found on Colt and Browning type automatic pistols, the rear sight is subjected to significant recoil forces which can damage the gun sight or even tear it off the slide. Components of conventional gun sights often are bent or otherwise loosened, thereby misaligning the sight during use. Gun sights with complicated mechanisms for elevation and windage adjustment are particularly prone to breakage or misalignment. The breaking or misalignment of a rear gun sight obviously significantly reduces the reliability of the firearm. When a damaged firearm is being used in competition, the marksman is severly disadvantaged. More importantly, in police and government applications, a defective firearm can lead to a loss of the user's life.

SUMMARY OF THE INVENTION

The object of the present invention is to provide a rear gun sight which is simple in design and structure and yet is strong and highly reliable. A further object is to provide a rear gun sight which when applied to the frame or slide of a firearm is positioned in close proximity to the firearm's center of gravity, thereby minimizing the recoil forces on the sight. Still another object is to provide recoil surfaces which minimize the tendency of the weapon's recoil to bend or break off part of the sight or misalign or bend intricate sight parts. Yet another object is to provide a sight having excellent elevation and windage adjustment characteristics, with a minimum of parts.

Additional objects and advantages of the invention will be set forth in part in the description which follows, and in part will be obvious from the description, or may be learned by practice of the invention. The objects and advantages may be realized and attained by means of the elements and combinations particularly pointed out in the appended claims.

To achieve the objects and in accordance with the purpose of the invention, as embodied and broadly described herein, the rear gun sight of this invention includes a rear sight in combination with the rear portion of a gun frame or slide comprising an elongated sight body having at least one elongated front leg with a forward sight body recoil shoulder for engaging the gun frame or slide and a sighting blade slidably attached to the rear of the sight body to permit windage adjustment of the sighting blade. An elongated slot is formed in the gun frame or slide and is sized to accept the sight body so that at least a portion of the sight body is held within the slot. The elongated slot forms at its forward end a frame recoil shoulder to engage the forward sight recoil shoulder of the sight body. The sight also includes means for pivotably attaching the sight body to the gun frame or slide to permit elevation adjustment of the sight body. Preferably the sight body is housed within the elongated slot, with the sight body recoil shoulder and the frame recoil shoulder engaging one another to bear the impact of the gun's recoil, when the gun is fired.

It is understood that both the foregoing general description and the following detailed description are exemplary and explanatory only and are not restrictive of the invention, as claimed.

The accompanying drawings, which are incorporated in and constitute a part of this specification, illustrate one embodiment of the invention and, together with the description, serve to explain the principles of the invention.

DETAILED DESCRIPTION OF THE PREFERRED EMBODIMENTS

Figure 1:
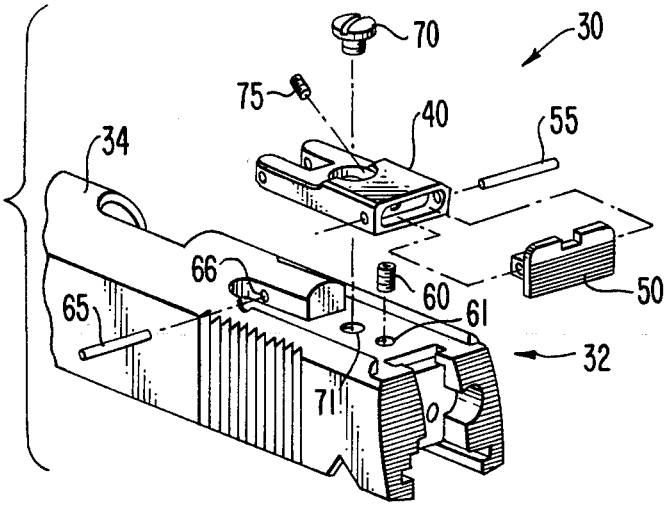
FIG. 1 is an exploded view showing the elements of the gun sight of the present invention and the rear portion of the slide of a firearm to which the invention is attached.
Figure 2:
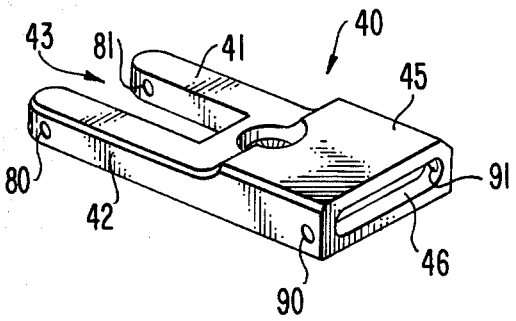
FIG. 2 is a perspective view of the sight body of the invention.
Figure 11:
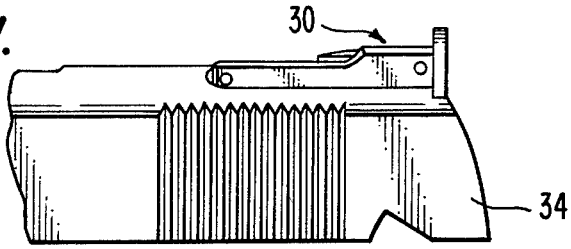
FIG. 11 is a side view illustrating the rear gun sight of the present invention fit within a slot formed in the slide of a firearm.
Figure 12:
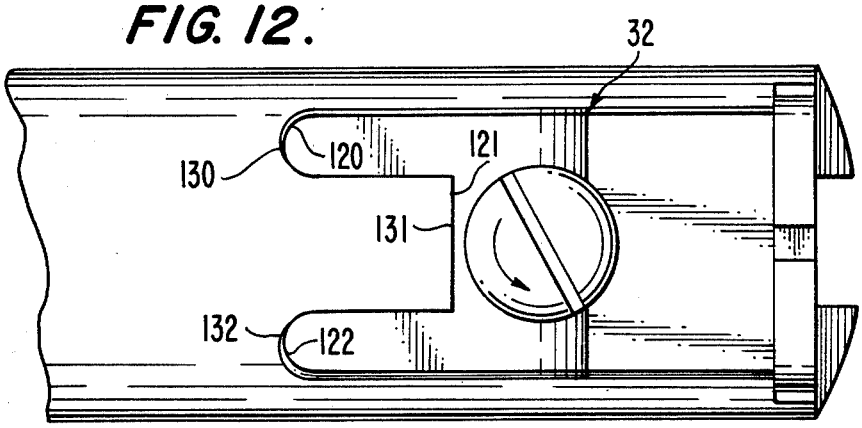
FIG. 12 is a plan view of the slide and rear sight illustrated in FIG. 11.

As illustrated generally in FIGS. 1, 11 and 12, the rear gun sight of the present invention, represented generally by the numeral 30, fits within a complementary slot, represented generally by the numeral 32, formed in the top surface of the rear portion of a firearm's slide 34. The drawings illustrate the rear sight 30 being attached to the slide of a 45-caliber pistol. However, it should be noted that the present invention may be attached to a wide variety of weapons, such as pistols, revolvers, rifles and automatic weapons. The rear sight of the present invention can be fixed to the firearm's slide or frame, depending upon the structure of the firearm.

Referring to FIG. 1, the rear sight of the present invention includes a sight body represented generally by the number 40, a sighting blade 50, a blade retaining pin 55, a tension spring 60, a sight body pivot pin 65, an elevation adjustment screw 70 and a windage lock screw 75.

Figure 3:
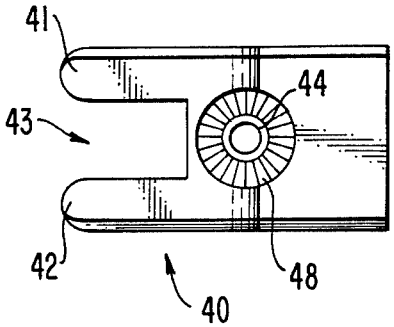
FIG. 3 is a top plan view of the sight body.
Figure 4:
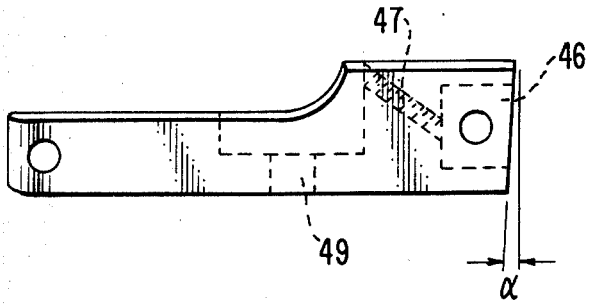
FIG. 4 is a side view of the sight body.
Figure 5:
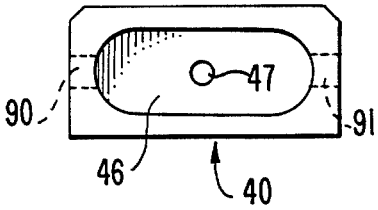
FIG. 5 is a rear view of the sight body.

The sight body 40 is shown in more detail in FIGS. 2 through 5. The sight body in its preferred form is cut from a single section of bar stock steel and includes two forward legs 41 and 42 which between them form a bight 43 as shown in FIG. 3. A recessed aperture 44 is formed in the central portion of the sight body 40, and the rear portion of the sight body gradually increases in thickness to add strength and stability to the sight body. As a result, the front portion of the sight body has a low mass and profile while the rear portion is sufficiently thick at aperature 44 and cavity 46 to provide a sturdy sight which will not bend. An open transverse cavity 46 is formed at the rear of the thicker portion 45 of the sight body. As shown in FIG. 4, the sight body 40 includes a threaded aperture 47 extending from the recessed aperture 44 to the transverse cavity 46 formed at the rear of the sight body. The recessed cavity 44 includes a plurality of teeth 48 which are formed to receive teeth 73 on elevation screw 70, shown in FIGS. 9 and 10. A bore 49 extends completely through the sight body and is perpendicular to the bottom surface of the sight body. The bore 49 is designed to receive the threaded shaft of elevation adjustment screw 70, and the recessed aperature 44 is designed to receive the head of screw 70. The sight body further includes a pair of aligned front holes 80 and 81 and a pair of aligned rear holes 90 and 91. These holes are designed to accept the sight body pivot pin 65, and the blade retaining pin 55, respectively. The bottom surfaces of legs 41 and 42 are slightly rounded to permit the sight body 40 to freely pivot about pivot pin 65. As shown in FIG. 4, the rear face of the sight body is beveled at an angle $\alpha$ of approximately 5°. As is explained in more detail below, this angulation of the near face cuts down any glare reflected by the sighting blade.

Figure 6:
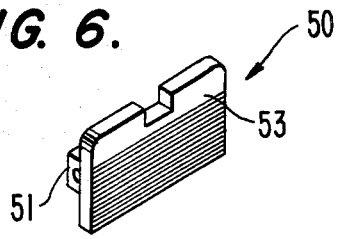
FIG. 6 is a perspective view of the sighting blade of the present invention.
Figure 7:
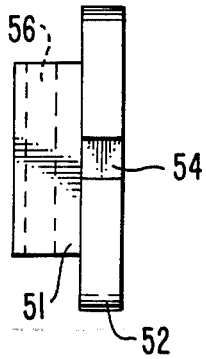
FIG. 7 is a plan view of the sighting plate.
Figure 8:
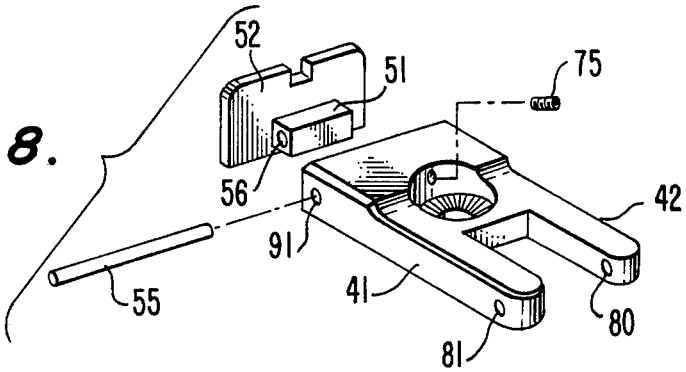
FIG. 8 is a exploded view illustrating how the sight body and the sighting blade are connected.

The sighting blade of the present invention is shown in more detail in FIGS. 6, 7 and 8. Again in the preferred embodiment, the sighting blade is built from a single piece of steel stock. The sighting blade 50 includes an integral rectangular boss 51, a rectangular plate 52, and a rear face 53 including stamped or cut lines to minimize glare. An elongated bore 56 is cut transversely through the boss 51, and the bore is sized to accept blade retaining pin 55.

FIG. 8 illustrates the relationship between the sighting blade 50 and the sight body 40. The boss 51 of the sighting blade is inserted into the cavity 46 formed at the rear of the sight body. The cavity 46 has a slightly longer transverse length than the boss 51, thereby allowing the sighting blade to slide transversely relative to the sight body. In a preferred embodiment, a clearance of 1/16–3/32 of an inch is provided between each transverse end of the boss 51 and the outer side wall of cavity 46. This degree of play from side to side allows for windage adjustment. It has been found that this degree of play provides a sufficient windage adjustment for a sight attached to the slide of a 45-calibre pistol. The degree of play appropriate for other firearms should be obvious to those of skill in the art. In contrast, the heights of the boss 51 and the cavity 46 are extremely close so that there is a friction fit between the top and bottom surfaces of the boss 51 and the top and bottom surfaces of the recess 46. As will be explained in more detail, this relationship allows the forced adjustment of the windage but in combination with windage lock screw 75 prevents any undesired movement of the blade during firing.

When the boss 51 is inserted into the cavity 46, the holes 91 and 90 and the bore 56 are aligned so that blade retaining pin 55 can be inserted through holes 90 and 91 and bore 56 to lock the sighting blade 50 and the sight body 40 together. The edges of the hole can be then swedged to hold the pin in place. Because of the close tolerances between the top and bottom surfaces of the boss 51 and cavity 46, sliding between the sighting blade 52 and sight body 40 is restricted. These close tolerances also prevent any relative pivoting of the blade to the sight body 40. However, the windage of the sight can still be adjusted by forcing the blade to a desired position. For example, this adjustment can be achieved by hitting a side of the sighting blade with a rubber hammer. Once the sight body is in the desired position, it can be held in place by wedge locking screw 75 which is threaded into hole 47 and against the surface of the boss 51.

As shown in FIGS. 1, 11 and 12, the sight body 40 in the preferred embodiment of the invention is positioned within a corresponding cavity formed in the top of the slide 34. The cavity conforms to the shape of the sight body and is designed to closely fit against the sight body when it is placed in the cavity. As shown, a hole 61 is drilled in the rear surface of the slide to house compression spring 60. Further, a threaded bore 71 is cut in the slide to accept elevation adjustment screw 70. Finally, a transverse bore 66 is cut in the slide adjacent the front of the cavity. As shown in FIG. 1, this bore is ultimately aligned with holes 80 and 81 in the sighting body 40 so that pivot pin 65 can be inserted through the holes and bore.

When attaching the rear sight of the present invention to the slide, the compression spring 60 is first placed within bore 61. Next, the assembled sight body and sighting pin are placed within the cavity until the front portion of the legs of the sighting body rest against the forward wall of the cavity. When in this position, the holes 80 and 81 of the sight body and the bore 65 are drilled or, if predrilled, are aligned so that sight body pivot pin 65 can be inserted through those holes to thereby pivotably fix the sight body to the slide. Finally, the elevation adjustment screw 70 is inserted into the recessed aperture 44, through hole 49 and into threaded hole 71. As the adjustment screw 70 is rotated, the elevation of the sight can be adjusted, as desired.

Figure 9:
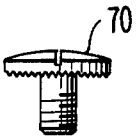
FIG. 9 is a side view of the elevation screw of the present invention.
Figure 10:
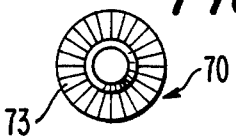
FIG. 10 is a bottom view of the elevation screw shown in FIG. 9.

As shown in FIG. 9 and 10, the elevation screw 70 includes teeth 73 which cooperate with teeth 48 formed in the recess. These teeth are designed to mesh with each other and in cooperation with compression spring 60 provide a locking feature for the elevation adjustment. This unique elevation adjustment system eliminates the need for detents, balls and other complex assemblies found in most systems and provides the user with audible and feelable clicks each time the teeth rotate to the next position. The inventor has found that a series of 24 teeth have provided an excellent elevation adjustment system, but it is also apparent that different numbers of teeth could be cut to calibrate the system as desired.

When the particular embodiment shown in the figures is used for a 45-caliber pistol, the sight body 40 has an overall length of 1.281 inches and a width of 0.687 inch. The forward legs 41 and 42 have a length of 0.5 inch and a width of 0.188 inch, and the front recoil shoulders of the legs are arcuate with a 3/32 inch radius.

Recessed aperature 44 is a ⅜ inch counterbore formed approximately 0.7 inch from the front recoil shoulders, and bore 49 has a diameter of 0.140 inch. The holes 80, 90 and 91 have a 0.094 inch diameter and receive pins 65 and 55, respectively, which have outer diameters of 0.094 inch. Bore 47 is sized to receive lock screw 75 and is angled at 11° from the horizontal. Finally, the cavity 46 has a height of approximately 0.187 inch, a transverse width of approximately 0.500 inch, and a longitudinal depth of 0.200 inch.

A sighting blade to fit the above described sight body would have a transverse width of 0.75 inch and a height of 0.437 inch. The top surface of the blade is preferably angled or raked forward an approximate 5° angle to provide its user with a single clean top sighting line. The boss 51 of the sighting blade has a height of 0.187 inch, a transverse width of 0.375 inch and a longitudinal depth of 0.187 inch.

The present invention when placed upon a slide provides a simple and effective adjustment for elevation and windage. To adjust the elevation, the user merely needs to rotate the elevation screw 70 with a screw driver. The compression spring 60 tends to rotate the rear portion of the sight body upward, as seen in FIG. 11, and by rotating the screw 70, the desired elevation can be readily obtained. Once the sight is in the desired position, the teeth 73 on the screw and the teeth 48 on the recessed mesh to hold the sight in the desired elevation position.

With respect to the windage, windage can be adjusted by loosening windage lock screw 75 and then forcing the setting blade 50 to the right or left, as desired. Generally, the slide can be moved to the left or right with a slight tapping motion of a rubber mallet, or a similar instrument. Once the blade is moved to the desired position, the blade can then be strongly locked in position by lock screw 75 and the friction force between the boss 51 and cavity 46.

A significant feature of the sight of the present invention is that it significantly minimizes the extent and effect of recoil. By placing the sight body in the cavity, the center of gravity of the sight body is closer to the axis of the barrel of the firearm. This design lessens the extent of torque between the sight body and the gun slide and also allows the use of a heavier and more sturdy sight body. As best illustrated in FIG. 12, the sight body 30 has three separate forward recoil shoulders 120, 121, and 122. The recoil shoulders of the sight body directly engage opposing recoil shoulders 130, 131 and 132 of the slide or frame of the firearm. Thus, when the slide recoils backward, the recoil force is impacted against these sturdy recoil shoulders. As a result, very little if any force is imparted against either the sight body pivot pin 65 or the elevation adjustment screw 70. The recoil characteristics of the present invention is in significant contrast to conventional sights which are held by dovetail joints or screws. Such sights often bend or break pivot pins or screws or become bent along the length of the sight body. The sight of the present invention provides an extremely strong and simple design not shown or suggested in the prior art.

Obviously, many modifications and variations of the present invention are possible in light of the above teachings. The sight body, recesses and blades could be made into different shapes without departing from the scope and spirit of the invention. For example, it would be possible to have a single large tongue or loop at the forward end of the sight body so that there would be one impact shoulder at the extreme forward portion of the sight body and two impact shoulders toward the middle portion of the sight body. Such a design would be effectively the reverse image of the legs of the sight body and the cavity shown in the figures.

Other embodiments of the invention will be apparent to the skilled in the art in consideration of the specification and practice of the invention disclosed herein. It is intended that the specification and examples be considered as exemplary only, with the true scope and spirit of the invention being indicated by the following claims.

What is claimed is:

1. A rear sight in combination with the rear portion of a gun frame or slide comprising:

an elongated sight body having a pair of elongated, transversively spaced front legs, each leg having a forward sight body recoil shoulder for engaging the gun frame or slide;

a sighting blade slidably attached to the rear of said sight body to permit windage adjustment of the sighting blade;

a longitudinal elongated slot formed in the gun frame or slide and sized to accept the sight body so that at least a portion of the sight body is held within the slot, said elongated slot forming at its forward end a pair of frame recoil shoulders to engage the respective forward sight body recoil shoulders of said sight body;

means for pivotably attaching said sight body to said gun frame to permit elevation adjustment of the sight body; and said sight body being fit within said elongated slot and said forward sight body recoil shoulders and said frame recoil shoulders engaging one another to bear the impact of the gun's recoil.

2. The rear gun sight and gun frame of claim 1 further comprising a third forward sight body recoil shoulder of said sight body formed between said pair of elongated legs and a third frame recoil shoulder formed by said slot to engage said third forward sight body recoil shoulder.

3. The gun sight and gun frame or slide of claim 1 further comprising means for adjusting the elevation of the sight body to a desired position and temporarily holding the sight body in a desired position.

4. The gun sight and gun frame or slide of claim 1 further comprising means for temporarily holding the sighting blade in a desired position.

5. The gun sight and gun frame or slide of claim 1 wherein said pivotably attaching means includes a bore extending transversely through the elongated front leg of the sight body, an aligned bore transversely extending through said gun frame or slide, and a sight body pivot pin extending through said bores.

6. The rear sight and gun frame or slide of claim 1 wherein said sight body includes an open transverse cavity formed at the rear end of said sight body and said sighting blade includes an integral boss, slidable transversely within said cavity.

7. The rear sight and gun frame or slide of claim 6 wherein the top and bottom surfaces of the cavity and the top and bottom surfaces of the boss engage one another to provide a friction fit.

8. The rear sight and gun frame or slide of claim 7 wherein the sight body and the sighting blade are fixed to each other by a blade retaining pin which extends through said sight body and said sighting blade.

9. The rear sight and gun frame or slide of claim 3 wherein the means for adjusting and temporarily holding the sight body includes a spring for biasing said sight body away from said gun frame or slide, a sight body aperture formed in the sight body rearwardly of the sight body pivot pin, a threaded aperture in said gun frame or slide aligned with said sight body aperture, and an elevation adjustment screw which extends through said sight body aperture and engages the threads of said threaded aperture.

10. The rear sight and gun frame or slide of claim 9 further comprising a first plurality of radial teeth formed in the bottom surface of said elevation adjustment screw and a second plurality of radial teeth formed in a top surface of said sight body, the two sets of teeth engaging one another.

11. The rear sight and gun frame or slide of claim 4 wherein said means for temporarily holding said sighting blade in a desired position includes a windage lock screw which threadably engages said sight body and which can upon rotation selectively engage said sighting blade.

12. The gun sight and gun frame or slide of claim 1 including a windage adjustment system consisting essentially of:

an open, transverse cavity formed within the rear portion of the sight body;

the sighting blade and a boss integral with the sighting blade and slidable transversely within said cavity to allow for windage adjustment within said cavity, said boss being sized to engage the top and bottom of said cavity to provide a friction fit;

means for attaching the sighting blade to the sight body; and means for temporarily holding the sighting blade in a desired position.

13. The windage adjustment system of claim 12 wherein the attaching means includes a blade retaining pin extending through said sight body and the boss of said sighting blade.

14. The windage adjustment system of claim 13 wherein the temporary holding means includes a lock screw which threadily engages said sight body and which upon rotation can selectively engage the boss of said sighting blade.

15. The gun sight and gun frame or slide of claim 1 including an elevation adjustment system consisting essentially of:

the means for pivotably attaching said sight body to said gun frame or slide;

means for biasing said sight body away from said gun frame or slide;

a sight body aperture formed in the sight body rearwardly of the axis about which said sight body pivots;

an elevation adjustment screw for extending through said sight body aperture and threadily engaging the gun frame or slide; and means for releasably locking said elevation adjustment screw relative to said sight body.

16. The elevation adjustment assembly of claim 15 wherein said locking means includes a first plurality of radial teeth formed in the bottom surface of said elevation adjustment screw and a second plurality of radial teeth formed in a top surface of said sight body, the two sets of teeth engaging each other.

17. The elevation adjustment assembly of claim 16 wherein said pivotably connecting means includes a pivot pin projecting through said sight body and said biasing means includes a spring positioned between said sight body and the gun frame or slide.

* * * * *